US012044238B2

(12) United States Patent
Kanatani et al.

(10) Patent No.: US 12,044,238 B2
(45) Date of Patent: Jul. 23, 2024

(54) GEAR PUMP OR MOTOR WITH COMMUNICATION PATHS TO SUCTION AND DISCHARGE IN CLOSED SPACE BETWEEN THE DRIVE AND DRIVEN GEARS

(71) Applicant: Shimadzu Corporation, Kyoto (JP)

(72) Inventors: Kenichi Kanatani, Kyoto (JP); Takuya Kokabu, Kyoto (JP)

(73) Assignee: SHIMADZU CORPORATION, Kyoto (JP)

( * ) Notice: Subject to any disclaimer, the term of this patent is extended or adjusted under 35 U.S.C. 154(b) by 0 days.

(21) Appl. No.: 17/789,335

(22) PCT Filed: Jan. 30, 2020

(86) PCT No.: PCT/JP2020/003407

§ 371 (c)(1),
(2) Date: Jun. 27, 2022

(87) PCT Pub. No.: WO2021/152767

PCT Pub. Date: Aug. 5, 2021

(65) Prior Publication Data

US 2023/0032135 A1 Feb. 2, 2023

(51) Int. Cl.
*F04C 2/18* (2006.01)
*F04C 2/08* (2006.01)

(52) U.S. Cl.
CPC ..... *F04C 2/18* (2013.01); *F04C 2/082* (2013.01); *F04C 2/086* (2013.01); *F04C 2240/30* (2013.01)

(58) Field of Classification Search
CPC .. F04C 2/18; F04C 2/082; F04C 2/086; F04C 2240/30
See application file for complete search history.

(56) References Cited

U.S. PATENT DOCUMENTS

2018/0372091 A1* 12/2018 Elder ..... F04C 2/18

FOREIGN PATENT DOCUMENTS

| | | | |
|---|---|---|---|
| CN | 109209861 | A | 1/2019 |
| CN | 209164072 | U | 7/2019 |
| JP | S51062102 | U | 5/1976 |
| JP | 200313868 | A | 1/2003 |

(Continued)

OTHER PUBLICATIONS

International Search Report (with English Translation) and Written Opinion (with English Translation) issued on Mar. 17, 2020 in corresponding International Patent Application No. PCT/JP2020/003407; 10 pages.

(Continued)

*Primary Examiner* — Mary Davis
(74) *Attorney, Agent, or Firm* — Maier & Maier, PLLC

(57) ABSTRACT

A gear pump or a gear motor in which a tooth groove is easily filled with a liquid. A gear pump includes a casing, a gear storage chamber, a suction passage, a discharge passage, a gear that is housed in the gear storage chamber and including a drive gear and a driven gear that rotate while meshing with each other, and a suction-side communication path that connects a first space and a tooth groove of the gear, the first space being a closed space formed by the drive gear and the driven gear meshing with each other, the tooth groove being opened to the suction passage.

10 Claims, 14 Drawing Sheets

(56) References Cited

FOREIGN PATENT DOCUMENTS

| | | | |
|---|---|---|---|
| JP | 201143106 | A | 3/2011 |
| JP | 2017223122 | A | 12/2017 |

OTHER PUBLICATIONS

Office Action issued on Mar. 23, 2023, in corresponding Chinese Application No. 202080079813.8, 14 pages.
Office Action issued on Apr. 25, 2023, in corresponding Japanese Application No. 2021-574362, 9 pages.
Extended Search Report issued on Oct. 2, 2023, in corresponding European Application No. 20916338.5, 8 pages.
Office Action issued on Nov. 16, 2023, in corresponding Chinese Application No. 202080079813.8, 16 pages.
Office Action issued on Apr. 10, 2024, in corresponding Chinese Application No. 202080079813.8, 13 pages.

* cited by examiner

GEAR PUMP OR MOTOR WITH COMMUNICATION PATHS TO SUCTION AND DISCHARGE IN CLOSED SPACE BETWEEN THE DRIVE AND DRIVEN GEARS

FIELD

The present invention relates to a gear pump or a gear motor.

BACKGROUND

Conventionally, a gear pump 100 includes a casing 102, a gear storage chamber 104 formed in the casing 102, a drive gear 106 and a driven gear 108 stored in the gear storage chamber 104 (FIG. 14). The drive gear 106 and the driven gear 108 mesh with each other, and when the drive gear 106 rotates, the driven gear 108 also rotates. When the gears 106 and 108 rotate, a liquid (hydraulic oil) enters tooth grooves 112 and 114 opened to a suction passage 110. When the gears 106 and 108 further rotate and the tooth grooves 112 and 114 are opened to a discharge passage 116, the liquid is discharged from the tooth grooves 112 and 114. Patent Document 1 discloses a gear pump having a similar configuration.

PATENT DOCUMENT

Patent Document 1: Japanese Unexamined Patent Application Publication No. 2017-223122

SUMMARY

The rotational speed of the drive gear 106 and the driven gear 108 may be, for example, about 50 or more revolutions per second. The centrifugal force generated by this rotation makes it difficult for the liquid to enter the tooth grooves 112 and 114 from the suction passage 110. When the tooth grooves 112 and 114 are not filled with the liquid, the transfer efficiency of the liquid is deteriorated.

An object of the present invention is to provide a gear pump or a gear motor in which a tooth groove is easily filled with a liquid.

In order to solve the above problems, a gear pump or a gear motor according to the present invention has a configuration as described below.

A gear pump or a gear motor according to the present invention includes: a casing; a gear storage chamber formed inside the casing; a suction passage for supplying a liquid from an outside of the casing to the gear storage chamber; a discharge passage for discharging the liquid from the gear storage chamber to the outside of the casing; a gear that is housed in the gear storage chamber and includes a drive gear and a driven gear that rotate while meshing with each other; and a suction-side communication path that connects a first space and a tooth groove of the gear, the first space being a closed space formed by the drive gear and the driven gear meshing with each other, the tooth groove being opened to the suction passage.

According to the present invention, since the liquid flows from the tooth groove opened to the suction passage to the first space formed by the meshing of the gears, the liquid easily enters the tooth groove. The transfer efficiency of the liquid can be enhanced.

DETAILED DESCRIPTION

A gear pump according to an embodiment of the present invention will be described with reference to the drawings. Since a gear motor of the present application has the same configuration as the gear pump, the description of the gear motor will be omitted.

First Embodiment

Figure 1:
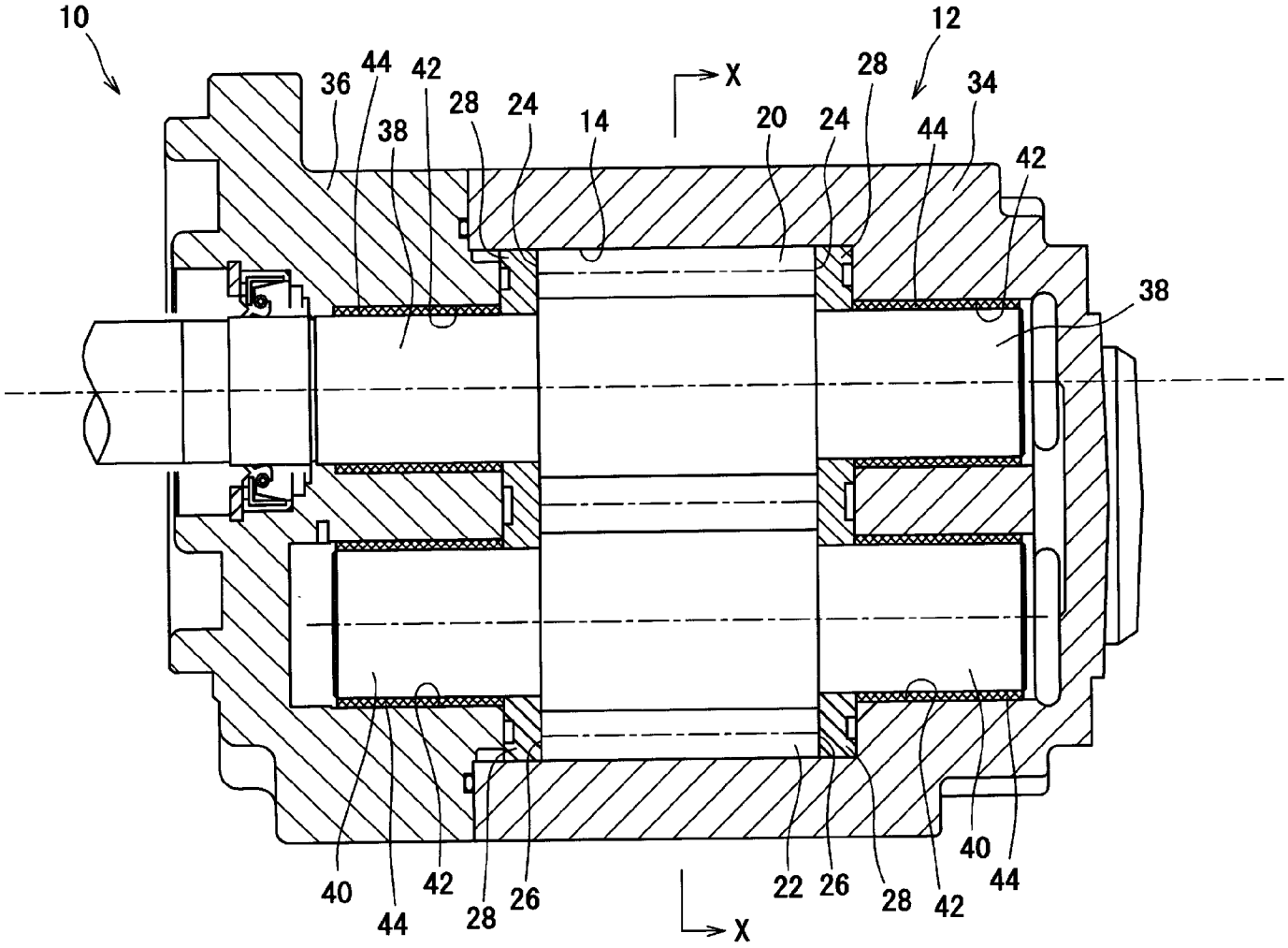
FIG. 1 is a view illustrating a configuration of a gear pump of the present application.
Figure 2:
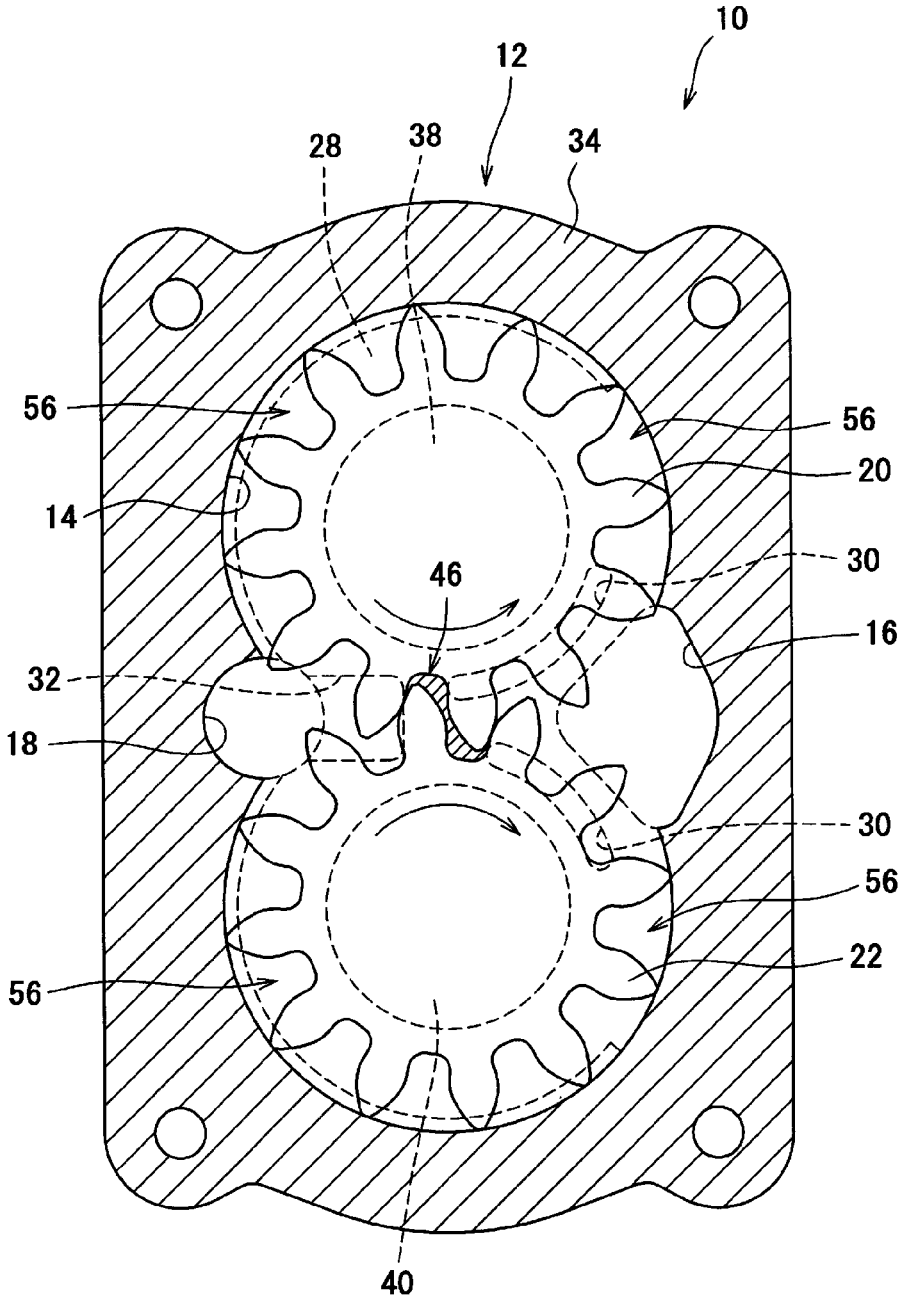
FIG. 2 is a sectional view taken along line X-X of FIG. 1.

A gear pump 10 of the present application illustrated in FIGS. 1 and 2 includes a casing 12, a gear storage chamber 14 formed in the casing 12, a suction passage 16 and a discharge passage 18 connected to the gear storage chamber 14, gears 20 and 22 stored in the gear storage chamber 14, side plates 28 in contact with side surfaces 24 and 26 of the gears 20 and 22, suction-side communication paths 30 and a discharge-side communication path 32 formed in each of the side plates 28.

[Casing]

The casing 12 includes a body 34 and a cover 36. The gear storage chamber 14 is formed inside the body 34. The gear storage chamber 14 is a space and is closed by the cover 36.

The suction passage 16 and the discharge passage 18 are formed in the casing 12 (FIG. 2). The suction passage 16 is a hole formed in the casing 12. A liquid (hydraulic oil) is supplied to the gear storage chamber 14 from the outside of the casing 12 through the suction passage 16. The discharge passage 18 is a hole formed in the casing. The liquid is discharged from the gear storage chamber 14 to the outside of the casing 12 through the discharge passage 18. The suction passage 16 and the discharge passage 18 are provided so as to face each other at the center in the longitudinal direction of the gear storage chamber 14. A pressure applied to the liquid in the suction passage 16 is relatively lower than a pressure applied to the liquid in the discharge passage 18.

[Gear]

The gears 20 and 22 are housed in the gear storage chamber 14. The gears 20 and 22 include a drive gear 20 and a driven gear 22. The drive gear 20 and the driven gear 22 mesh with each other, and when the drive gear 20 rotates, the driven gear 22 also rotates. A drive shaft 38 is provided at the center of the side surfaces 24 of the drive gear 20, and the drive shaft 38 is perpendicular to the side surfaces 24 of the drive gear 20. The drive gear 20 and the drive shaft 38 are integrated. A driven shaft 40 is provided at the center of the side surfaces 26 of the driven gear 22, and the driven shaft 40 is perpendicular to the side surfaces 26 of the driven gear 22. The driven gear 22 and the driven shaft 40 are integrated.

Bearing holes 42 are provided in the body 34 and the cover 36. The bearing holes 42 are connected to the gear storage chamber 14. Ring-shaped bushes 44 are fixed to an inner wall forming each of the bearing holes 42. The drive shaft 38 and the driven shaft 40 are rotatably supported by the bushes 44.

[First Space]

Figure 3:
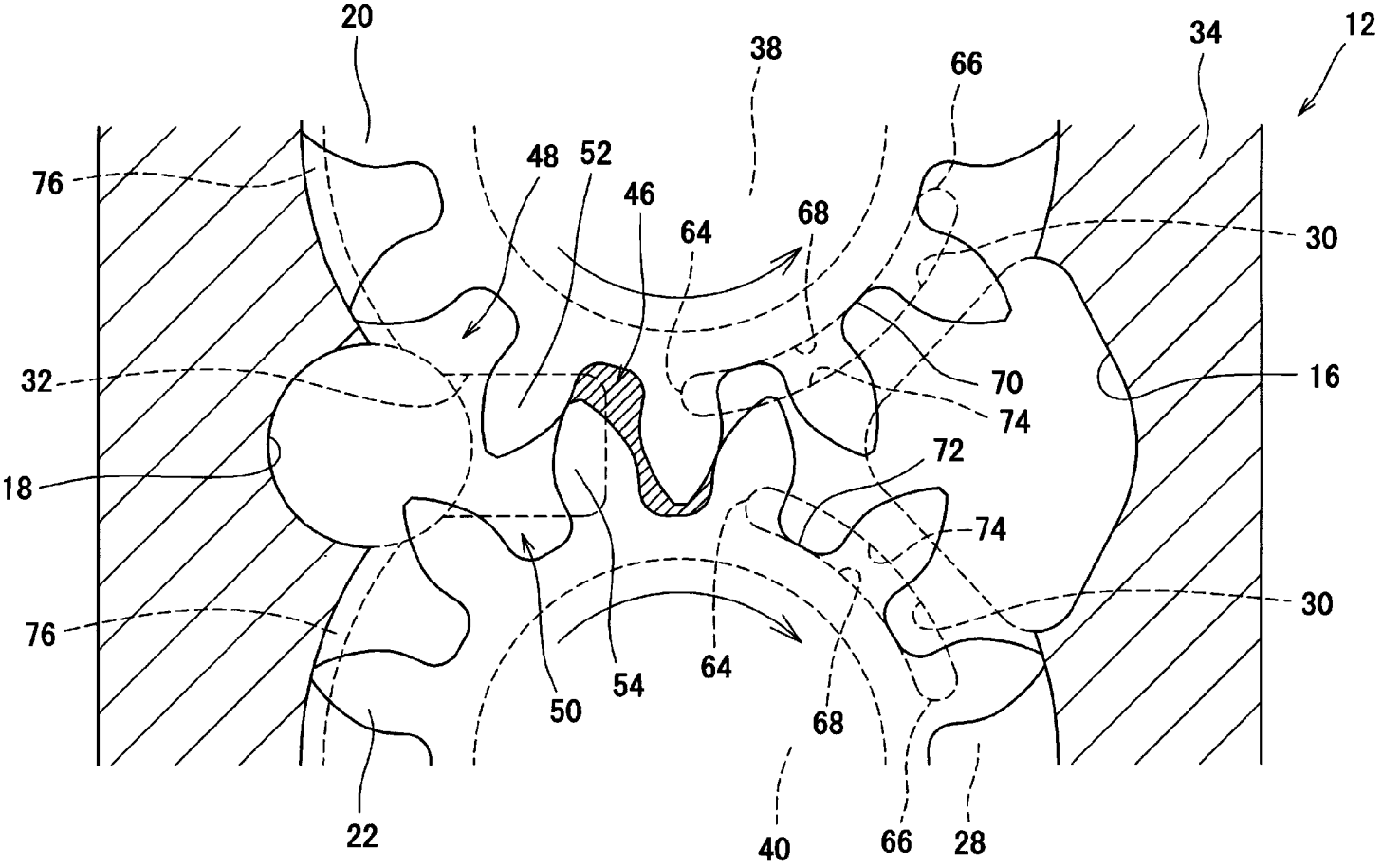
FIG. 3 is a view illustrating a first space at a position where a liquid is in a compressed state.

The drive gear 20 and the driven gear 22 mesh with each other, and a closed space is formed by the drive gear 20 and the driven gear 22 (FIG. 3). This closed space is defined as a first space 46. As the drive gear 20 and the driven gear 22 rotate, the position of the first space 46 moves. The shape of the first space 46 changes depending on the position, and the state of the liquid that has entered the first space 46 changes. This change in the state of the liquid will be described.

First, when the drive gear 20 and the driven gear 22 rotate and teeth 52 and 54 mesh with each other, tooth grooves 48 and 50 of the gears 20 and 22 opened to the discharge passage 18 are closed, and the first space 46 is formed (FIG. 3). The liquid that has entered the first space 46 is compressed by the drive gear 20 and the driven gear 22. The liquid in the first space 46 is pushed out from the discharge-side communication path 32.

As the drive gear 20 and the driven gear 22 rotate, the volume of the first space 46 is gradually reduced. After the volume of the first space 46 is most reduced (FIG. 4), the volume of the first space 46 is expanded (FIG. 5). Since the volume of the first space 46 is expanded, the liquid in the first space 46 is expanded. A force for allowing the liquid to enter the first space 46 from the outside of the first space 46 is generated, and the liquid enters the first space 46 through the suction-side communication paths 30.

As described above, the liquid in the first space 46 is changed from a compressed state to an expanded state. Furthermore, as the drive gear 20 and the driven gear 22 rotate, the tooth grooves 48 and 50 of the gears 20 and 22 are opened to the suction passage 16.

[Second Space]

Figure 6:
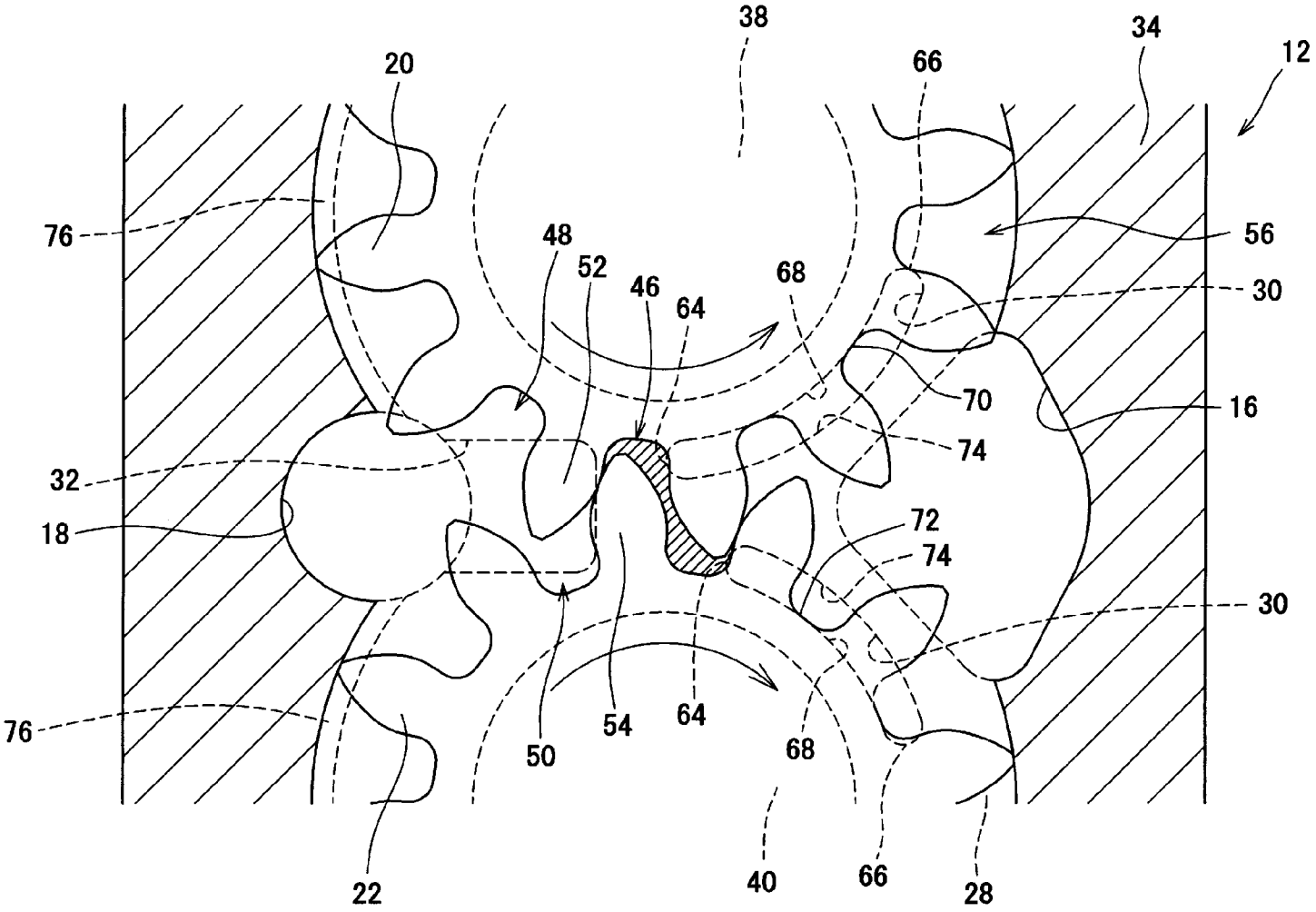
FIG. 6 is a view illustrating a position of a gear in which a second space is formed.

Tooth tips of the teeth 52 and 54 of the drive gear 20 and the driven gear 22 are in contact with an inner wall of the casing 12 forming the gear storage chamber 14. In this state, the drive gear 20 and the driven gear 22 rotate. A closed space is formed by the inner wall of the casing 12 forming the gear storage chamber 14 and each of the tooth groove 48 of the gear 20 and the tooth groove 50 of the gear 22. This closed space is defined as a second space 56 (FIG. 6).

[Side Plate]

Figure 7:
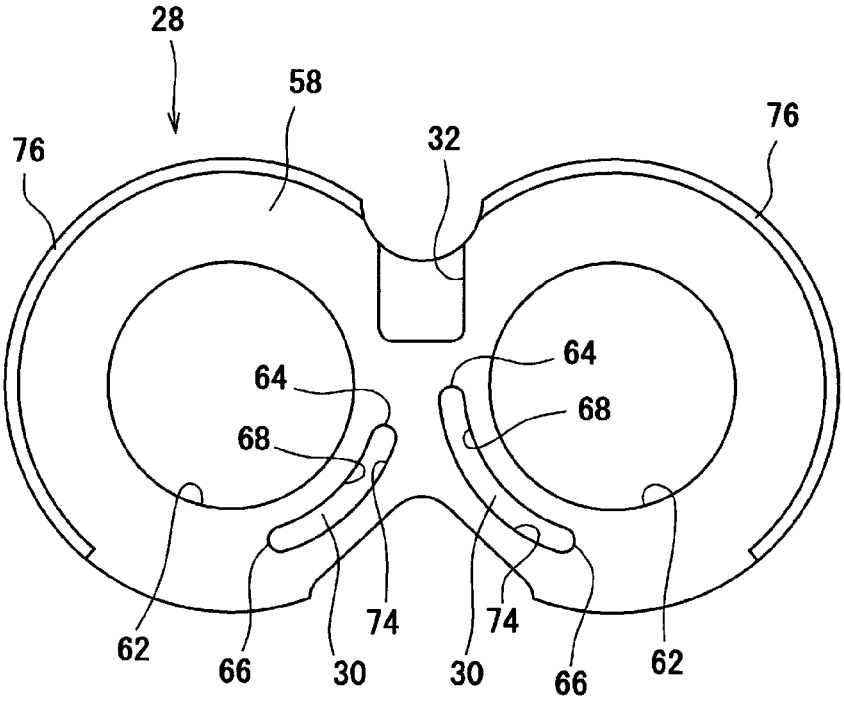
FIG. 7 is a view illustrating a first surface of a side plate.
Figure 8:
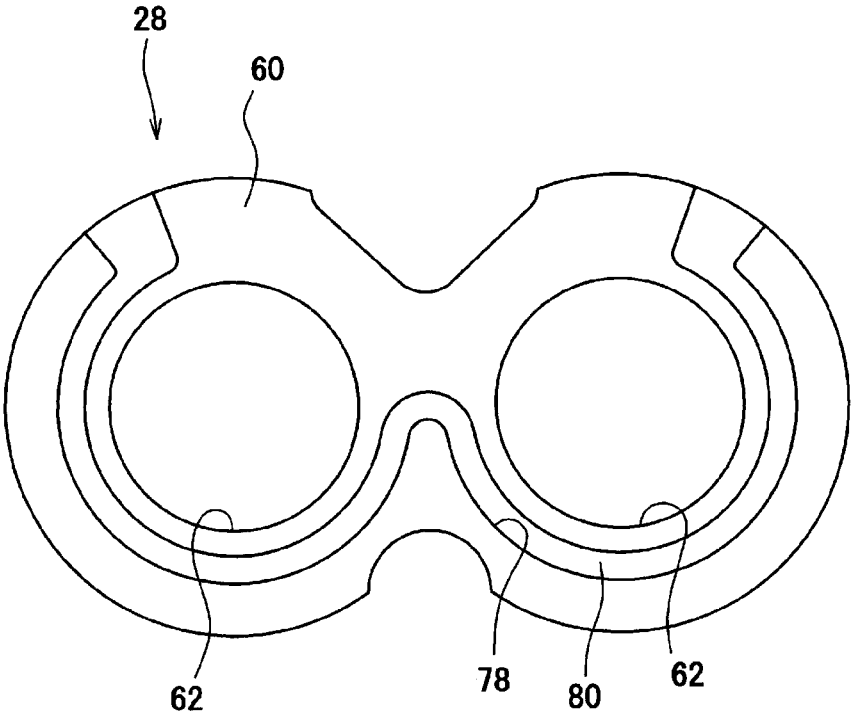
FIG. 8 is a view illustrating a second surface of the side plate.

Each of the side plates 28 is a plate body including a first surface 58 illustrated in FIG. 7 and a second surface 60 illustrated in FIG. 8. Each side plate 28 is housed in the gear storage chamber 14. The first surface 58 of the side plate 28 is in contact with the side surfaces 24 and 26 of the gears 20 and 22, and the gears 20 and 22 rotate in this state. The side plate 28 includes shaft holes 62, and the drive shaft 38 and the driven shaft 40 pass through the respective shaft holes 62.

[Suction-Side Communication Path]

The suction-side communication paths 30 are formed in the first surface 58 of the side plate 28 (FIG. 7). Each of the suction-side communication paths 30 is a recess formed by recessing the first surface 58. Each suction-side communication path 30 has a band shape including a first end 64 and a second end 66. The suction-side communication path 30 has an arc shape centered on the drive shaft 38 or the driven shaft 40. An inner periphery 68 of the suction-side communication path 30 coincides with the trajectory of a tooth bottom 70 of the gear 20 or a tooth bottom 72 of the gear 22 (FIG. 3). An outer periphery 74 of the suction-side communication path 30 may be in the tooth grooves 48 or 50.

The first ends 64 of the suction-side communication paths 30 are connected to the first space 46. The volume of the first space 46 connected to the first ends 64 is expanded. In other words, the first ends 64 of the suction-side communication paths 30 are disposed at respective positions where the liquid in the first space 46 is in the expanded state (FIG. 5). The suction-side communication paths 30 are connected to the respective tooth grooves 48 and 50 of the gears opened to the suction passage 16. The suction-side communication paths 30 connect the first space 46 in which the liquid is in the expanded state and the tooth grooves 48 and 50 opened to the suction passage 16. The liquid is sent from the tooth grooves 48 and 50 to the first space 46 through the suction-side communication paths 30. The first ends 64 are preferably disposed at the positions where the volume of the first space 46 starts to expand. When the volume of the first space 46 starts to expand, the liquid is guided to the first space 46, and the liquid easily enters the tooth grooves 48 and 50.

When the tooth grooves 48 and 50 are opened to the suction passage 16, the liquid tends to enter the tooth grooves 48 and 50. However, the gears 20 and 22 rotate at a high speed, for example, about 50 rotations per second, and a centrifugal force acts on the liquid in the tooth grooves 48 and 50. This centrifugal force makes it difficult for the liquid to enter the tooth grooves 48 and 50. In the present application, the liquid is sucked into the first space 46 from the tooth grooves 48 and 50 through the suction-side communication paths 30. Therefore, a force for sucking the liquid acts on the tooth grooves 48 and 50, and the liquid easily enters the tooth grooves 48 and 50 as compared with conventional cases. Since the tooth grooves 48 and 50 are filled with the liquid, air hardly enters the tooth grooves 48 and 50. Since the first ends 64 are disposed at the respective positions where the volume of the first space 46 starts to expand, the liquid easily enters the tooth grooves 48 and 50 when the first space 46 starts to expand.

The second ends 66 of the suction-side communication paths 30 are not connected to the respective second spaces 56 (FIG. 6). The second ends 66 are disposed at respective positions immediately in front of the positions where the second spaces 56 are formed. Since the liquid is sucked into the first space 46 until immediately before the second spaces 56 are formed, the tooth grooves 48 and 50 are easily filled with the liquid, and air hardly enters the tooth grooves 48 and 50. The second spaces 56 sufficiently filled with the liquid is easily formed. Since the second spaces 56 are not connected to the respective suction-side communication paths 30, the liquid that has entered the second spaces 56 does not escape toward the first space 46 or the tooth grooves 48 and 50 opened to the suction passage 16.

[Discharge-Side Communication Path]

The discharge-side communication path 32 is formed in the first surface 58 of the side plate 28. The discharge-side communication path 32 is a recess formed by recessing the first surface 58. The discharge-side communication path 32 has a quadrangular shape or a shape similar to the quadrangular shape. The discharge-side communication path 32 is provided at the center in the longitudinal direction of the side plate 28 and on the discharge passage 18 side.

The discharge-side communication path 32 is connected to the first space 46 and the tooth grooves 48 and 50 opened to the discharge passage 18. The volume of the first space 46 is reduced, and the liquid in the first space 46 is in the compressed state (FIG. 3). The discharge-side communication path 32 is disposed at the position of the first space 46 the volume of which is reduced. When the liquid is compressed, the liquid flows from the first space 46 toward the discharge passage 18. When the drive gear 20 and the driven gear 22 mesh with each other to form the first space 46, a part of the liquid in the tooth grooves 48 and 50 opened to the discharge passage 18 enters the first space 46, but the liquid that has entered the first space 46 can be sent to the discharge passage 18 through the discharge-side communication path 32, and the transfer efficiency of the liquid can be increased.

Figure 4:
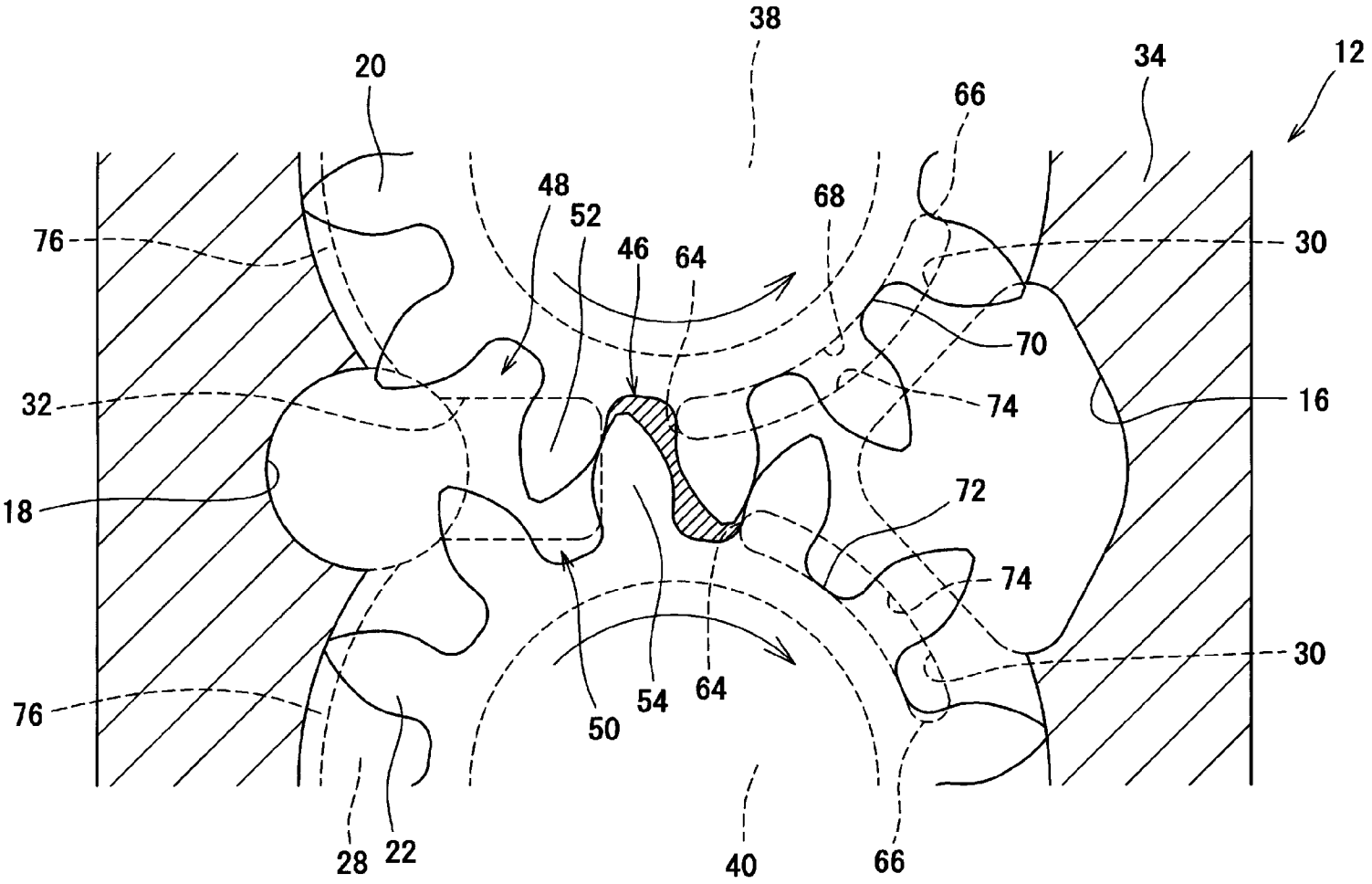
FIG. 4 is a view illustrating the first space at a position where the liquid is neither in the compressed state nor in an expanded state.
Figure 5:
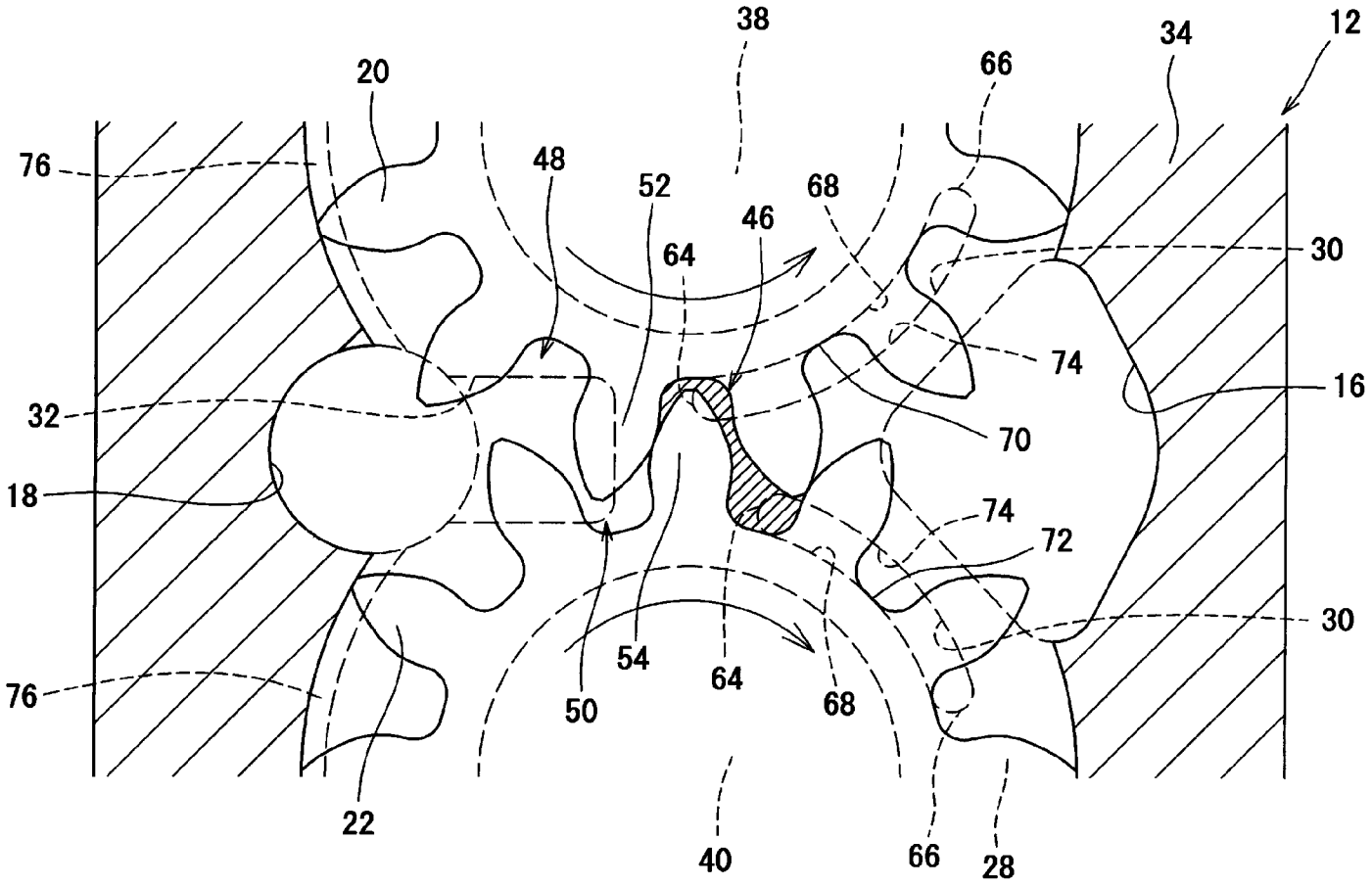
FIG. 5 is a view illustrating the first space at a position where the liquid is in the expanded state.

At the position where the volume of the first space 46 is the smallest, neither the suction-side communication paths 30 nor the discharge-side communication path 32 is disposed (FIG. 4). The suction-side communication paths 30 and the discharge-side communication path 32 are not connected through the first space 46. The suction passage 16 and the discharge passage 18 are not directly connected.

[High-Pressure Introducing Groove]

High-pressure introducing grooves 76 are formed in the first surface 58 of the side plate 28. Each of the high-pressure introducing grooves 76 is a recess formed by recessing the outer periphery of the first surface 58. Each high-pressure introducing groove 76 is connected to the discharge passage 18. Some of the second spaces 56 are connected to the high-pressure introducing grooves 76, and the other second spaces 56 are not connected to the high-pressure introducing grooves 76. After each of the second spaces 56 is formed, the second space 56 is connected to the corresponding high-pressure introducing groove 76 after a short time, instead of being immediately connected to the high-pressure introducing groove 76. The suction passage 16 and the discharge passage 18 are not connected through the high-pressure introducing grooves 76 or the second spaces 56.

[Gasket]

A recess 78 is formed in the second surface 60 of the side plate 28, and a gasket 80 is disposed in the recess 78 (FIG. 8). The gasket 80 is a line-shaped member having elasticity. The gasket 80 is in close contact with an inner wall forming the gear storage chamber 14. Even if the second surface 60 of the side plate 28 forms a gap with respect to the inner wall forming the gear storage chamber 14, the gasket 80 prevents the suction passage 16 and the discharge passage 18 from being connected to each other.

[Liquid Flow]

(1) When the drive gear 20 rotates, the driven gear 22 also rotates accordingly. The liquid that has entered the gear storage chamber 14 from the suction passage 16 enters the tooth grooves 48 and 50 opened to the suction passage 16. The tooth grooves 48 and 50 are connected to the first space 46 through the suction-side communication paths 30. The volume of the first space 46 connected to the suction-side communication paths 30 is large, and the liquid flows from the tooth grooves 48 and 50 to the first space 46 through the suction-side communication paths 30. The liquid easily enters the tooth grooves 48 and 50.

(2) When the gears 20 and 22 further rotate, the tooth tips contact the inner wall forming the gear storage chamber 14, and the second spaces 56 are formed. As described above, since the liquid easily enters the tooth grooves 48 and 50, the second spaces 56 are filled with the liquid as compared with conventional cases. Since the second spaces 56 are not connected to the suction-side communication paths 30, the liquid does not flow from the second spaces 56 to the suction-side communication paths 30. As the positions of the second spaces 56 move, the second spaces 56 are connected to the respective high-pressure introducing grooves 76, and the second spaces 56 have the same pressure as the discharge passage 18 has.

(3) When the gears 20 and 22 further rotate, the tooth grooves 48 and 50 are opened to the discharge passage 18, and the liquid in the tooth grooves 48 and 50 flows to the discharge passage 18. In a state where a part of the liquid remains in the tooth grooves 48 and 50, the drive gear 20 and the driven gear 22 mesh with each other to form the first space 46. Since the drive gear 20 and the driven gear 22 compress the liquid that has entered the first space 46, the liquid flows from the first space 46 to the discharge passage 18 through the discharge-side communication path 32.

By repeating the above (1) to (3), the liquid flows from the suction passage 16 to the discharge passage 18.

As described above, in the present application, the liquid in the tooth grooves 48 and 50 can be sent to the first space 46 by the suction-side communication paths 30, and the liquid easily enters the tooth grooves 48 and 50. When the second spaces 56 are formed, the second spaces 56 are easily filled with the liquid. In the present application, the transfer efficiency of the liquid can be increased as compared with conventional cases.

Second Embodiment

Figure 9:
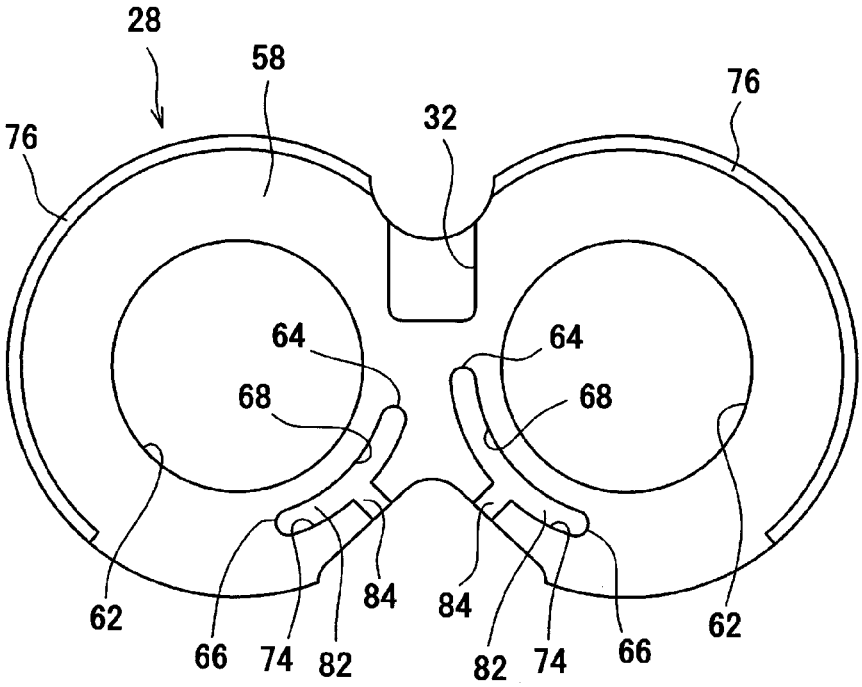
FIG. 9 is a view illustrating another mode of the side plate.

As illustrated in FIG. 9, suction-side communication paths 82 may each include a passage 84 connected from the outer periphery 74 to the outer periphery of the side plate 28. The liquid directly enters the first space 46 from the suction passage 16. Since the liquid is contained in the first space 46, the tooth grooves 48 and 50 opened to the suction passage 16 are easily filled with the liquid.

Third Embodiment

Figure 10:
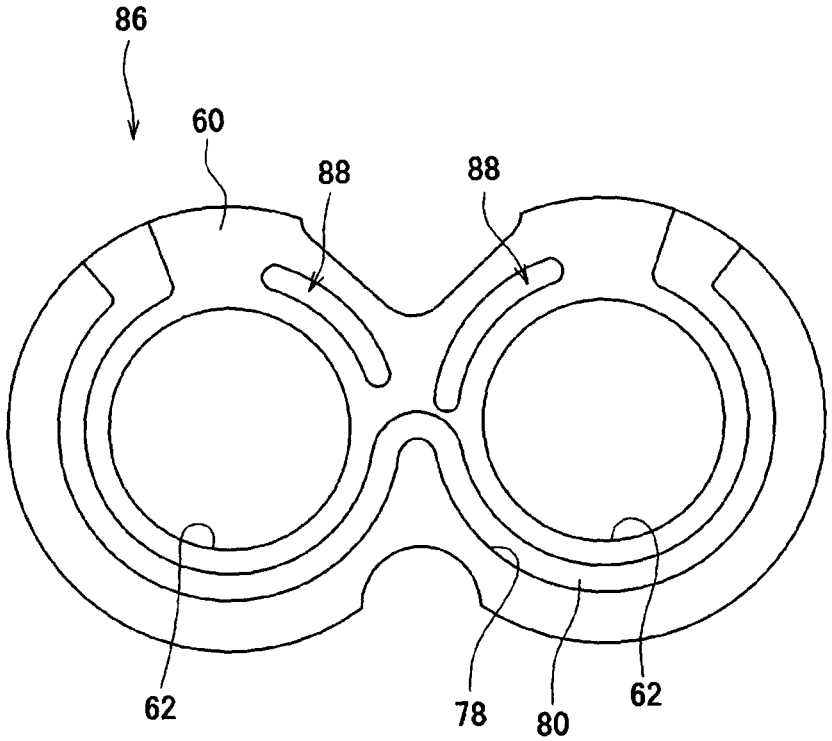
FIG. 10 is a view illustrating suction-side communication paths including through holes.

Suction-side communication paths 88 of a side plate 86 in FIG. 10 are through holes penetrating from the first surface 58 to the second surface 60 of the side plate 86. Even when the suction-side communication paths 88 are through holes, the liquid can flow from the suction passage 16 to the first space 46 as in the first embodiment. As compared with the first embodiment, the volume of the suction-side communication passages 88 increases, and the amount of the liquid passing through the suction-side communication passages 88 increases.

Figure 11:
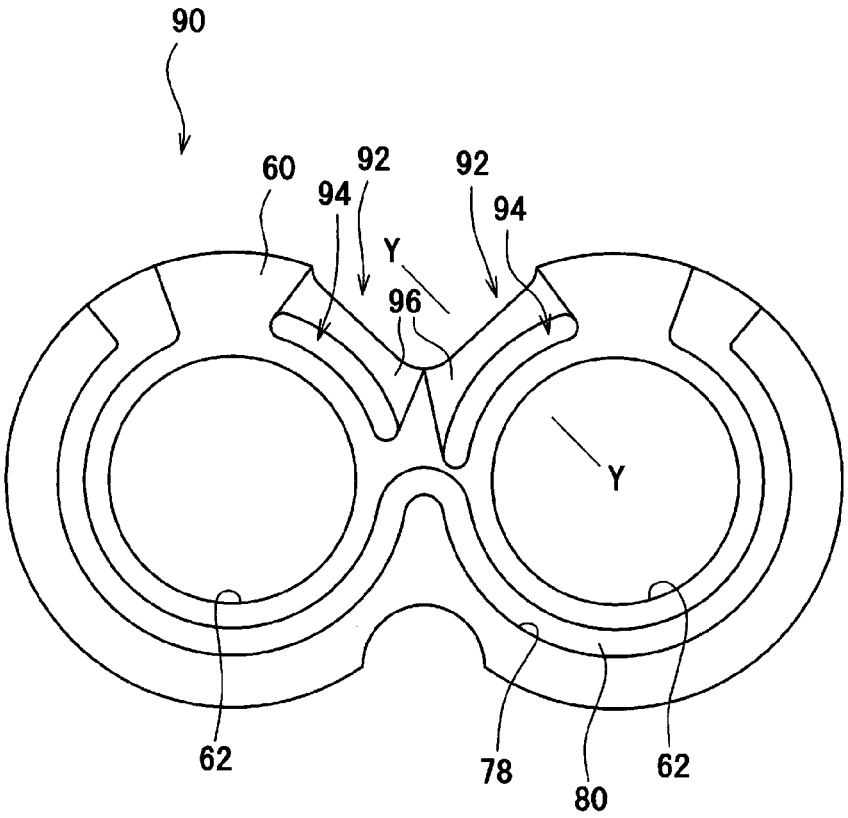
FIG. 11 is a view illustrating suction-side communication paths including through holes and recesses in the second surface.
Figure 12:
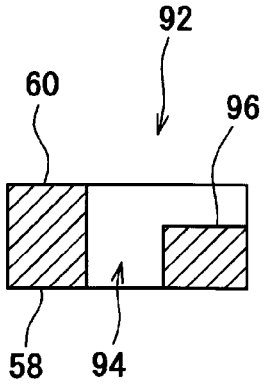
FIG. 12 is a sectional view taken along line Y-Y in FIG. 11.

Suction-side communication passages 92 of a side plate 90 in FIG. 11 each include a through hole 94 and a recess 96 connected to the through hole 94. The recess 96 of the second surface 60 is connected from the suction passage 16 to the through hole 94. The liquid is sent to the first space 46 through the suction passage 16, the recess 96, and the through hole 94. Even when the side plate 28 is changed to the side plate 86 or 90, the liquid flows from the suction passage 16 to the first space 46 through the suction-side communication paths 88 or 92.

Fourth Embodiment

Figure 13:
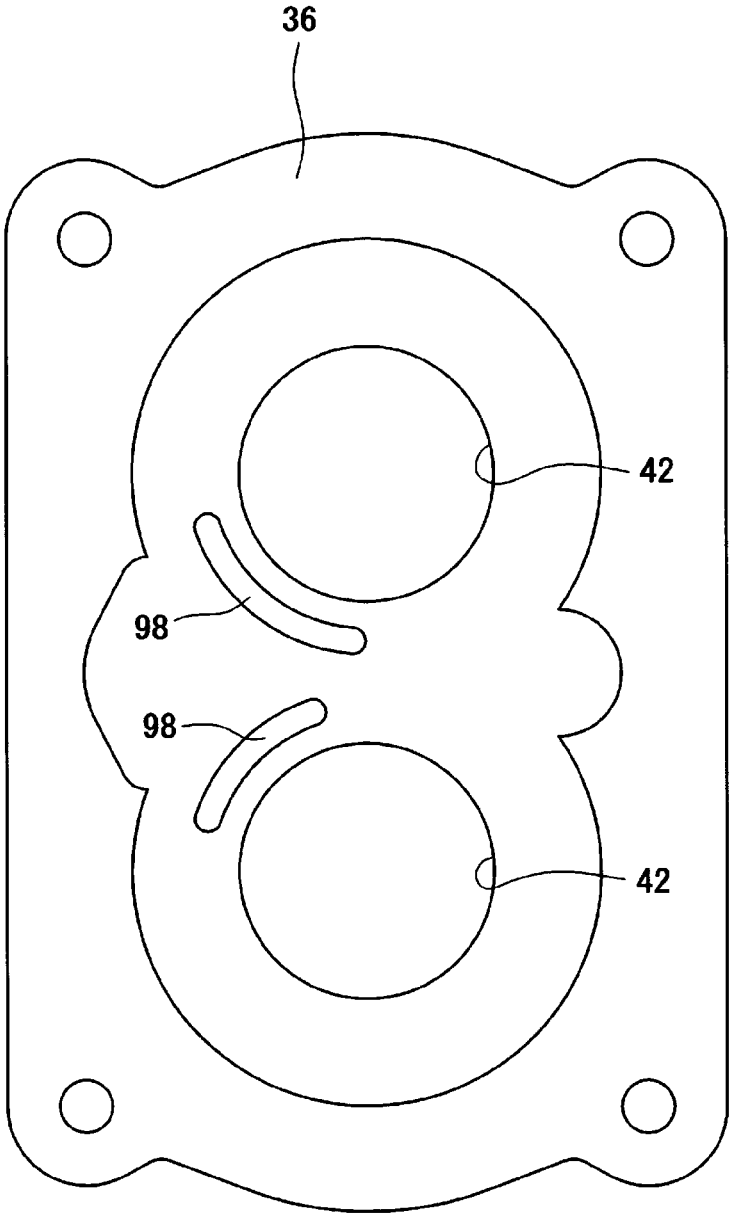
FIG. 13 is a view illustrating suction-side communication paths formed in a cover.
Figure 14:
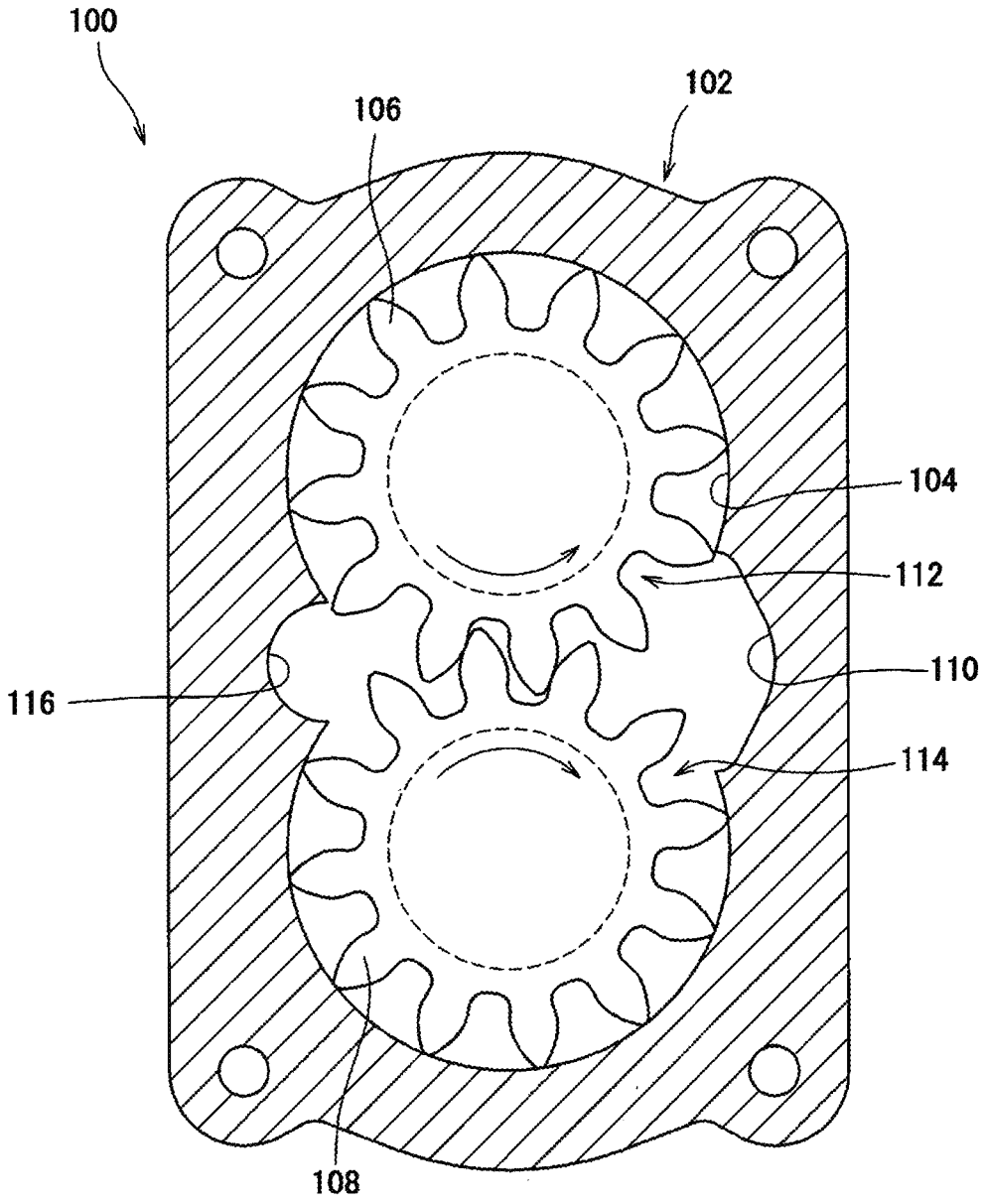
FIG.14 (prior art)
FIG. 14 is a view illustrating a drive gear and a driven gear housed in a conventional gear storage chamber.

When the side plate 28 is omitted and the side surfaces 24 and 26 of the gears are in contact with the inner wall forming the gear storage chamber 14, recesses similar to the suction-side communication passages 30 illustrated in FIG. 7 may be formed in the inner wall. For example, when the cover 36 illustrated in FIG. 13 is in contact with the side surfaces 24 and 26 of the gears, suction-side communication passages 98 are formed in the cover 36. As in the above embodiments, the liquid can be supplied from the suction passage 16 to the first space 46 through the suction-side communication passages 98.

In the present application, as long as the suction-side communication passages 30, 88, 92, and 98 can supply the liquid from the suction passage 16 to the first space 46, the shapes of the suction-side communication passages 30, 88, 92, and 98 are not limited.

(Item 1) A gear pump or a motor according to the present application includes: a casing; a gear storage chamber formed inside the casing; a suction passage for supplying a liquid from an outside of the casing to the gear storage chamber; a discharge passage for discharging the liquid from the gear storage chamber to the outside of the casing; a gear that is housed in the gear storage chamber and includes a drive gear and a driven gear that rotate while meshing with each other; and a suction-side communication path that connects a first space and a tooth groove of the gear, the first space being a closed space formed by the drive gear and the driven gear meshing with each other, the tooth groove being opened to the suction passage.

According to the gear pump or the motor described in item 1, the liquid flows from the tooth groove opened to the suction passage to the first space formed by the meshing of the gears. The liquid easily enters the tooth groove opened to the suction passage. The transfer efficiency of the liquid can be enhanced.

(Item 2) The gear pump or the gear motor includes a side plate that is a plate body having a first surface and a second surface and is disposed such that the first surface is in contact with a side surface of the gear. The suction-side communication path includes a recess formed in a first surface of a side plate or a through hole penetrating from a first surface to a second surface of a side plate.

According to the gear pump or the motor described in item 2, the recess or the through hole is simply provided in the side plate, and the configuration is simple.

(Item 3) The suction-side communication path is a recess formed in an inner surface forming a gear storage chamber in a casing.

According to the gear pump or the motor described in item 3, the recess is simply provided in the inner wall forming the gear storage chamber, and the configuration is simple.

(Item 4) The suction-side communication path is a recess having a band shape including a first end and a second end.

According to the gear pump or the motor described in item 4, the liquid in the tooth groove can flow into the first space through the suction-side communication path.

(Item 5) A liquid in a first space changes from a compressed state to an expanded state by rotation of the drive gear and the driven gear, and the first end of the suction-side communication path is disposed at a position where the liquid in the first space is expanded.

According to the gear pump or the motor described in item 5, since the first end of the suction-side communication path is located at a position where the liquid in the first space is in the expanded state, the liquid can be guided from the tooth groove to the first space.

(Item 6) The gear pump or the gear motor includes a discharge-side communication path that is a recess formed in the first surface of the side plate and that connects a position where the liquid in the first space is compressed and a tooth groove of a gear, the tooth groove being opened to the discharge passage.

According to the gear pump or the gear motor described in item 6, the liquid in the compressed state can flow to the discharge passage through the discharge-side communication path. The transfer efficiency of the liquid can be enhanced.

In addition, the present invention can be implemented in a mode in which various improvements, modifications, and changes are added based on the knowledge of those skilled in the art without departing from the gist of the present invention.

REFERENCE SIGNS LIST

10: gear pump
12: casing
14: gear storage chamber
16: suction passage
18: discharge passage
20: drive gear
22: driven gear
24: side surface of drive gear
26: side surface of driven gear
28, 86, 90: side plate
30, 82, 88, 92, 98: suction-side communication path
32: discharge-side communication path
34: body
36: cover
38: drive shaft
40: driven shaft
42: bearing hole
44: bush
46: first space
48, 50: tooth groove
52, 54: tooth
56: second space
58: first surface of side plate
60: second surface of side plate
62: shaft hole
64: first end of suction-side communication path
66: second end of suction-side communication path
68: inner periphery of suction-side communication path
70, 72: tooth bottom
74: outer periphery of suction-side communication path
76: high-pressure introducing groove
78: recess in second surface of side plate
80: gasket
84: passage connected to suction-side communication path
94: through hole
96: groove

The invention claimed is:

1. A gear pump or a gear motor comprising:

a casing;

a gear storage chamber formed inside the casing;

a suction passage for supplying a liquid from an outside of the casing to the gear storage chamber;

a discharge passage for discharging the liquid from the gear storage chamber to the outside of the casing;

a pair of gears housed in the gear storage chamber and includes a drive gear and a driven gear that rotate while meshing with each other; and a suction-side communication path that connects a first space and one of a plurality of tooth grooves of at least one of the pair of gears, the first space being a closed space formed by the drive gear and the driven gear meshing with each other, the tooth groove being opened to the suction passage, wherein, the suction-side communication path has a first end connected to the first space and a second end opened to the suction passage, a plurality of second spaces, each of which is a closed space, are each formed by an inner wall of the casing forming the gear storage chamber and one of the tooth grooves of the drive gear or of the driven gear, and the second end of the suction-side communication path is provided at a position immediately before the second space formed closest to the suction passage when a tooth tip of a tooth of the drive gear or the driven gear passing through the suction passage contacts the inner wall, and is not connected to the second space.

2. The gear pump or the gear motor according to claim 1, wherein the suction-side communication path has a band shape including a first end and a second end.

3. The gear pump or the gear motor according to claim 2, wherein a liquid in a first space changes from a compressed state to an expanded state by rotation of the drive gear and the driven gear, and the first end of the suction-side communication path is disposed at a position where the liquid in the first space is expanded.

4. The gear pump or the gear motor according to claim 1, wherein the suction-side communication path has an arc shape including a first end and a second end, centered on a drive shaft or a driven shaft.

5. The gear pump or the gear motor according to claim 4, wherein an inner periphery of the suction-side communication path coincides with the trajectory of each tooth bottom of the drive gear and the driven gear.

6. The gear pump or the gear motor according to claim 4, wherein a liquid in a first space changes from a compressed state to an expanded state by rotation of the drive gear and the driven gear, and the first end of the suction-side communication path is disposed at a position where the liquid in the first space is expanded.

7. The gear pump or the gear motor according to claim 1, wherein the suction-side communication path connects a plurality of the tooth grooves.

8. The gear pump or the gear motor according to claim 1, comprising a side plate that is a plate body having a first surface and a second surface and is disposed such that the first surface is in contact with a side surface of at least one of the pair of gears, wherein the suction-side communication path includes a recess formed in a first surface of a side plate.

9. The gear pump or the gear motor according to claim 1, wherein the suction-side communication path is a recess formed in an inner surface forming a gear storage chamber in a casing.

10. The gear pump or the gear motor according to claim 1, comprising a discharge-side communication path that connects a position where the liquid in the first space is compressed and a tooth groove of at least one of the pair of gears, the tooth groove being opened to the discharge passage.

* * * * *